US009414627B2

(12) United States Patent
Liu

(10) Patent No.: US 9,414,627 B2
(45) Date of Patent: Aug. 16, 2016

(54) ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 420 days.

(21) Appl. No.: 14/031,389

(22) Filed: Sep. 19, 2013

(65) Prior Publication Data

US 2015/0027462 A1 Jan. 29, 2015

(30) Foreign Application Priority Data

Jul. 26, 2013 (CN) ..... 2013 2 0452509 U

(51) Int. Cl.
*A24F 47/00* (2006.01)
*A24F 7/00* (2006.01)

(52) U.S. Cl.
CPC ..... *A24F 47/008* (2013.01); *A24F 7/00* (2013.01)

(58) Field of Classification Search
CPC ..... A24F 47/008
See application file for complete search history.

(56) References Cited

U.S. PATENT DOCUMENTS 4,226,250 A * 10/1980 Ehrenpreis ..... A24F 13/06 131/187
4,446,878 A * 5/1984 Porenski, Jr. ..... A24D 3/045 131/336
4,570,645 A * 2/1986 Newman, Sr. ..... A24F 13/14 131/175
2011/0168194 A1* 7/2011 Hon ..... A24F 47/008 131/273
2011/0303231 A1* 12/2011 Li ..... A24F 47/008 131/329
2012/0103350 A1* 5/2012 Roth ..... A61M 15/06 131/273
2012/0318283 A1* 12/2012 Watanabe ..... A24F 47/002 131/191
2013/0056013 A1* 3/2013 Terry ..... A24F 47/008 131/328
2014/0007863 A1* 1/2014 Chen ..... A24F 47/008 128/200.14
2014/0041655 A1* 2/2014 Barron ..... A61M 11/042 128/202.21
2014/0109905 A1* 4/2014 Yamada ..... A61M 15/06 128/203.27
2014/0318557 A1* 10/2014 Bremer ..... A24F 1/00 131/328

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

An electronic cigarette is provided, comprising an outer sleeve and a suction nozzle cap mounted at one end of the outer sleeve; wherein, the suction nozzle cap is sheathed on the outer sleeve, and an inner wall of the suction nozzle cap is located at the outside of an outer wall of the outer sleeve. The suction nozzle cap is sheathed on the outer sleeve, the disassembly of the suction nozzle cap is more convenient, and the structure design of the suction nozzle cap is diversified.

12 Claims, 10 Drawing Sheets

ELECTRONIC CIGARETTE

CROSS-REFERENCE TO RELATED APPLICATIONS

This non-provisional application claims priorities under 35 U.S.C. §119(a) on Patent Application No. 201320452509.0 filed in P.R. China on Jul. 26, 2013, the entire contents of which are hereby incorporated by reference.

FIELD OF THE INVENTION

The present application relates to the field of electrical cigarettes, and more particularly, relates to an electronic cigarette with a suction nozzle cap mounted on the outside of an atomizer sleeve or an outer protective sleeve.

BACKGROUND OF THE INVENTION

Electronic cigarettes, which are also called virtual cigarettes or electronic atomizers, are mainly used for smoking cessation and substituting cigarettes. The electronic cigarettes have appearances which look like cigarettes, taste like real cigarettes, and even have much more tastes than ordinary real cigarettes. Smoke can also be sucked from the electronic cigarettes, and the smoke smells and feels like smoke of real cigarettes.

Electronic cigarettes are classified as disposable electronic cigarettes and non-disposable electronic cigarettes. A disposable electronic cigarette adopts an outer protective sleeve to accommodate components such as an atomizer, a battery, and a controller. A non-disposable electronic cigarette usually adopts an atomizer sleeve to accommodate an atomizer, and adopts a battery sleeve to accommodate a battery and a controller (i.e. to form a battery pole).

In the prior art, a suction nozzle cap of a disposable electronic cigarette is generally mounted inside the outer protective sleeve, and a suction nozzle cap of a non-disposable electronic cigarette is generally mounted inside the atomizer sleeve. The electronic cigarettes with these structures are difficult to disassemble, and designs of the suction nozzle caps of the electronic cigarettes follow the same pattern.

SUMMARY OF THE INVENTION

The objective of the present application is to provide an electronic cigarette with a suction nozzle cap mounted on the outside of an atomizer sleeve or an outer protective sleeve, aiming at the above-mentioned drawbacks in the prior art that suction nozzle caps of electronic cigarettes are difficult to disassemble, and designs of the suction nozzle caps follow the same pattern.

The technical solutions of the present application for solving the technical problems are as follows: in one aspect, an electronic cigarette comprises an outer sleeve and a suction nozzle cap mounted at one end of the outer sleeve, the suction nozzle cap is sheathed on the outer sleeve, and an inner wall of the suction nozzle cap is located at the outside of an outer wall of the outer sleeve.

In one embodiment, the suction nozzle cap includes an end cap facing an opening end of the outer sleeve and a combined body sheathed on the outer sleeve, and the end cap defines a smoking hole.

In one embodiment, a cross section of the combined body is round, oval or polygonal.

In one embodiment, an axial length of the combined body ranges from 20 mm to 33 mm.

In one embodiment, the end cap and the combined body are integrated.

In one embodiment, an edge of an inner wall of the end cap abuts with the opening end of the outer sleeve, and a central axis of the smoking hole is aligned with or deviates from a central axis of the outer sleeve.

In one embodiment, a first reserved space is formed between the inner wall of the end cap and the opening end of the outer sleeve.

In one embodiment, a central axis of the smoking hole is aligned with or deviates from a central axis of the outer sleeve; an annular bulge extends from an edge of the end cap corresponding to a circumference of the smoking hole to the opening end of the outer sleeve axially; and a flange configured to abut against the opening end of the outer sleeve is formed at a contraction portion of the end cap corresponding to the combined body and located adjacent to the combined body.

In one embodiment, a central axis of the smoking hole is perpendicular to a central axis of the outer sleeve.

In one embodiment, an inner wall of the combined body and the outer wall of the outer sleeve form any one of interference fit, buckled connection, and threaded connection.

In one embodiment, at least one convex rib or at least one groove is radially formed on a circumference of a portion of the outer wall of the outer sleeve that contacts the inner wall of the combined body, and at least one groove or at least one convex rib is radially formed on the inner wall of the combined body correspondingly, and the combined body and the outer sleeve are mutually buckled.

In one embodiment, an external thread or an internal thread is radially formed on a circumference of a portion of the outer wall of the outer sleeve that contacts the inner wall of the combined body, an internal thread or an external thread is radially formed on the inner wall of the combined body correspondingly, and the combined body and the outer sleeve are thread-connected.

In one embodiment, the combined body is elastic, and the combined body and the outer sleeve form interference fit using relative toughness chimera.

In one embodiment, a first chamfer configured to facilitate the outer sleeve to insert into the combined body is formed at an edge of the inner wall of an end of the combined body away from the end cap.

In one embodiment, a sealing ring is sheathed on one end of the outer sleeve facing the suction nozzle cap, a second reserved space is formed between one end of the sealing ring near the suction nozzle cap and the opening of the outer sleeve, and a third reserved space is formed between one end of the sealing ring away from the suction nozzle cap and an atomizer received in the outer sleeve.

In one embodiment, the sealing ring defines a first containing chamber and a through hole; the first containing chamber is configured for condensing tobacco tar, and the first containing chamber is shaped as a round table and is formed by gradually reducing a diameter of an edge of the sealing ring; the through hole communicates with the smoking hole, and is aligned with or deviates from the smoking hole.

In one embodiment, a third chamfer configured to facilitate the sealing ring to insert into the outer sleeve is formed at an edge of the outer wall of one end of the sealing ring away from the smoking hole.

In one embodiment, the combined body includes a first combined part and a second combined part, a crease line is formed between the first combined part and the second combined part, the first combined part is fixedly connected with the end cap, and an identification region is formed on the outer wall of the second combined part.

When implementing the electronic cigarette of the present application, the following advantageous effects can be achieved: because the suction nozzle cap is sheathed on the outside of the atomizer sleeve or the outer protective sleeve, the suction nozzle cap can be replaced, and the disassembly of the suction nozzle cap is more convenient. Furthermore, the structure design and the pattern design of the suction nozzle cap are diversified, and the material of the suction nozzle cap is also diversified. The suction nozzle cap is connected to the atomizer sleeve or the outer protective sleeve more stably and reliably. The outer wall of the suction nozzle cap can be designed into various shapes, so that it is easy to clamp the electronic cigarette, and the electronic cigarette is not prone to fall off. The electronic cigarette does not need an additional independent cigarette holder, therefore, the demand of users to the shape of the cigarette holder can be met.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

To make the technical feature, objective and effect of the present application be understood more clearly, now the specific implementation of the present application is described in detail with reference to the accompanying drawings and embodiments.

Aiming at the above-mentioned drawbacks in the prior art that suction nozzle caps of electronic cigarettes are difficult to disassemble, and designs of the suction nozzle caps follow the same pattern, the present application provides an electronic cigarette which comprises an outer sleeve and a suction nozzle cap mounted at one end of the outer sleeve. Wherein, the suction nozzle cap is sheathed on the outer sleeve, and an inner wall of the suction nozzle cap is mounted on the outside of an outer wall of the outer sleeve.

A First Embodiment

Figure 1:
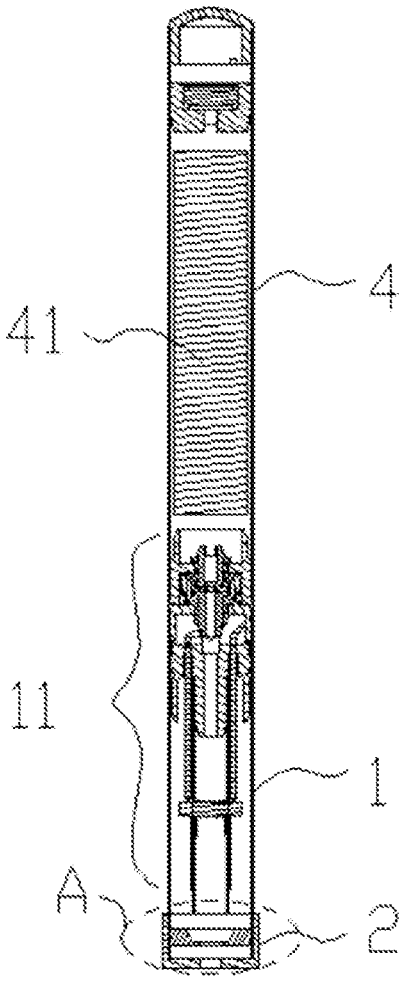
FIG. 1 is a cutaway view of an electronic cigarette of a first embodiment of the present application.
Figure 2:
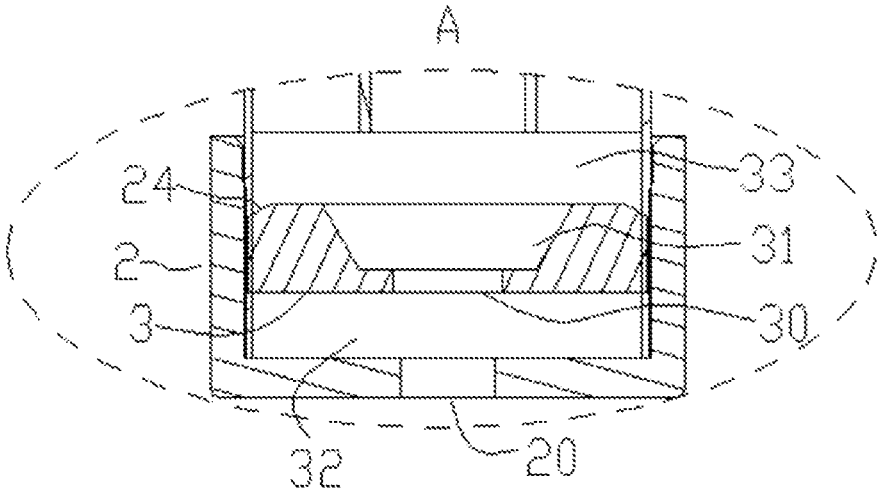
FIG. 2 is an enlarged view of the area A shown in FIG. 1.
Figure 3A:
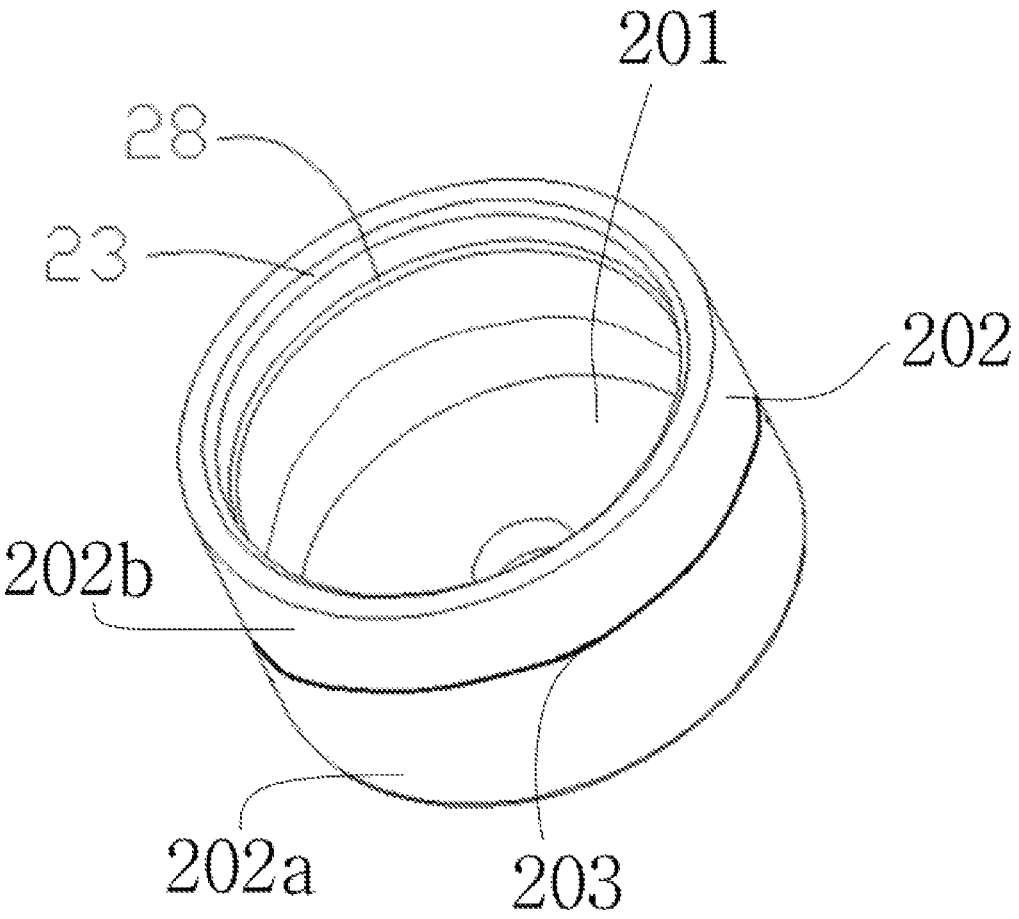
FIG. 3A is a three-dimensional structural view of a suction nozzle cap of the first embodiment of the present application.
Figure 3B:
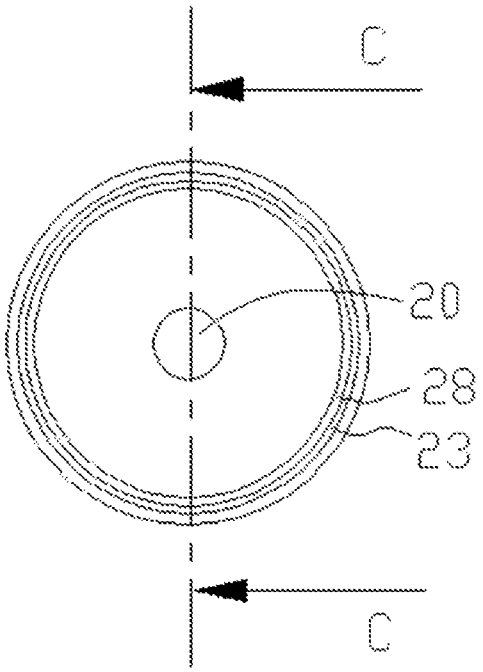
FIG. 3B is a vertical view of the suction nozzle cap of the first embodiment of the present application.
Figure 3C:
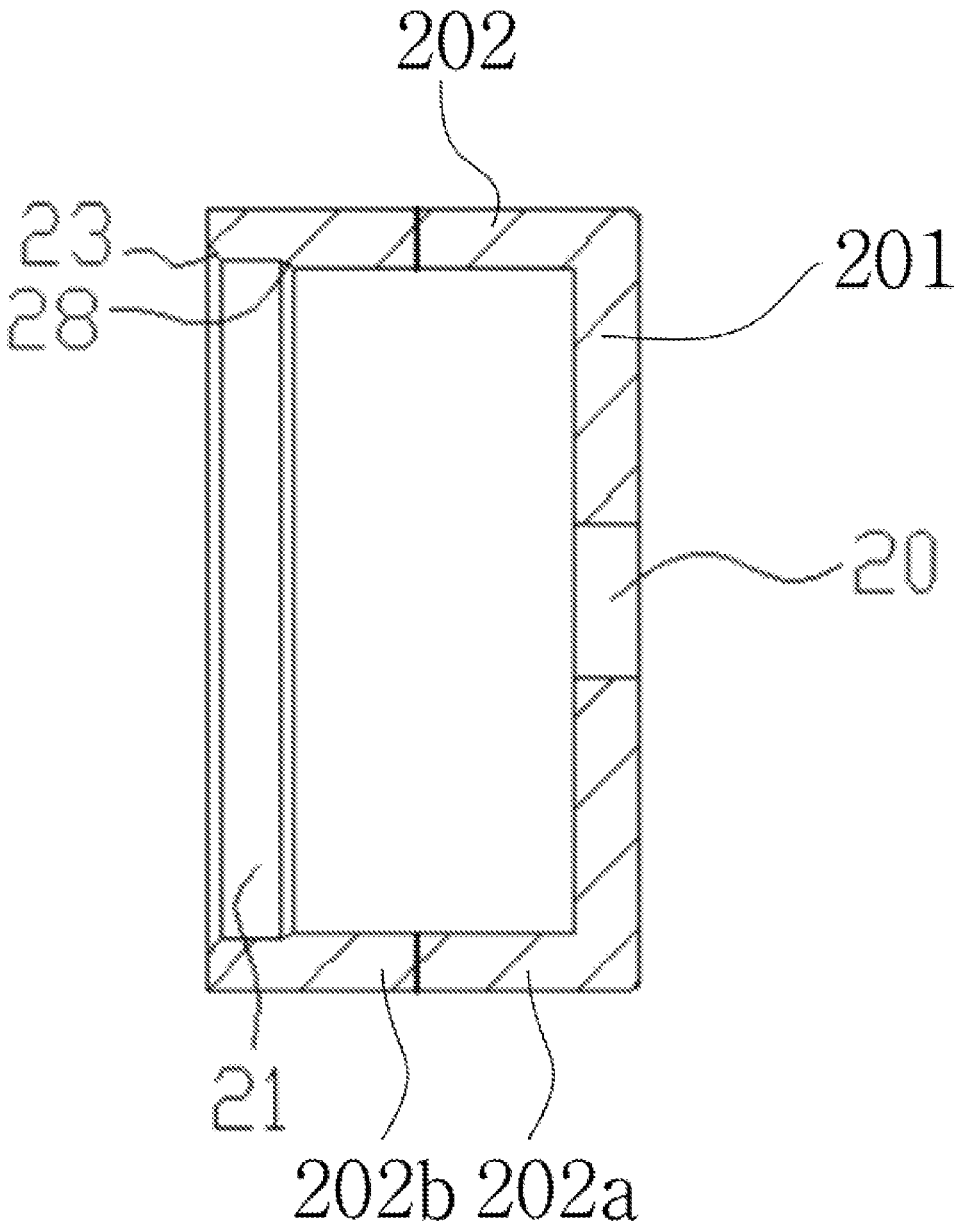
FIG. 3C is a cutaway view along the C-C line shown in FIG. 3B.

The first embodiment is a non-disposable electronic cigarette, referring to FIG. 1-FIG. 3C, which comprises an outer sleeve 1 and a suction nozzle cap 2 mounted on one end of the outer sleeve 1. Wherein, the suction nozzle cap 2 is sheathed on the outer sleeve 1, and an inner wall of the suction nozzle cap 2 is located on the outside of an outer wall of the outer sleeve 1. An atomizer 11 is accommodated in the outer sleeve 1. The electronic cigarette further comprises a battery sleeve 4, and a battery 41 is accommodated in the battery sleeve 4 to supply power to the atomizer 11.

The suction nozzle cap 2 includes an end cap 201 facing an opening end of the outer sleeve 1 and a combined body 202 sheathed on the outer sleeve 1, and the end cap 201 and the combined body 202 are integrated.

A cross section of the combined body 202 can be round, oval or polygonal, and a cross section of the end cap 201 has the same shape as the cross section of the combined body 202. By designing the combined body 202 to be in these shapes, the connection between the outer sleeve 1 and the suction nozzle cap 2 can be more stable and more liable. Furthermore, because the outer wall of the combined body 202 can be designed to be in various shapes, it is easy to clamp the electronic cigarette, and the electronic cigarette is not prone to fall off. In this embodiment, the cross section of the combined body 202 is designed to be round for aesthetic consideration.

An axial length of the combined body 202 ranges from 20 mm to 33 mm. In this embodiment, 27 mm is a preferred value. In one aspect, such an axial length can simulate a shape of a real cigarette well; in another aspect, it is more convenient to clamp the electronic cigarette.

A smoking hole 20 is defined along the axial direction of the end cap 201, and a central axis of the smoking hole 20 is aligned with or deviates from a central axis of the outer sleeve 1. This embodiment prefers that the central axis of the smoking hole 20 is aligned with the central axis of the outer sleeve 1. The smoking hole 20 is used for discharging smoke to a mouth of a user.

A reserved space can be formed between the inner wall of the end cap 201 and the opening end of the outer sleeve 1, and at least one through hole can be defined at a circumference of the inner wall of the end cap 201 coating the reserved space and is used to replace the smoking hole 20 to discharge the smoke to the mouth of the user. A flange can be formed at a contraction portion of the end cap 201 corresponding to the combined body 202, and is located adjacent to the combined body 202 to abut against an edge of the opening end of the outer sleeve 1. In this embodiment, the reserved space is not defined, so an edge of the inner wall of the end cap 201 directly abuts against an edge of the opening end of the outer sleeve 1.

The inner wall of the combined body 202 is sheathed on the outer wall of the outer sleeve 1 corresponding to the combined body 202 along a preset sheathed direction. The inner wall of the combined body 202 and the outer wall of the outer sleeve 1 form an interference fit, a buckled connection or a threaded connection. The design of this structure can make material selection of the suction nozzle cap 2 be more diversified, for example, the suction nozzle cap 2 can be made of metals (such as copper), plastics (such as POM), soft rubbers (such as silica gel), ceramics, paper, wood, and so on. When an interference fit or a fastening connection is adopted, the suction nozzle cap 2 can be made of plastics, soft rubbers, paper, and wood. When a screw connection is adopted, the suction nozzle cap 2 can be made of metals, ceramics, and wood.

If the inner wall of the combined body 202 needs to be connected with the outer wall of the outer sleeve 1 by a buckled connection, there are two implementation methods. A first method is that: at least one convex rib or at least one groove is formed radially on a circumference of a portion of the outer wall of the outer sleeve 1 contacting the inner wall of the combined body 202, at least one groove or at least one convex rib is formed radially on the inner wall of the combined body 202 correspondingly, and the combined body 202 and the outer sleeve 1 are mutually buckled. The second method is that: at least one convex rib or at least one groove is formed axially on the circumference of a portion of the outer wall of the outer sleeve 1 contacting the inner wall of the combined body 202, at least one groove or at least one convex rib is formed axially on the inner wall of the combined body 202 correspondingly, and the combined body 202 and the outer sleeve 1 are mutually buckled.

If the combined body 202 is connected with the outer sleeve 1 by a thread connection, an external thread or an internal thread is formed radially on a circumference of a portion of the outer wall of the outer sleeve 1 contacting the inner wall of the combined body 202, an internal thread or an external thread is formed radially on the inner wall of the combined body 202 correspondingly, and a thread connection is formed between the combined body 202 and the outer sleeve 1.

If the inner wall of the combined body 202 is connected with the outer wall of the outer sleeve 1 by an interference fit connection, the combined body 202 can be designed to be elastic, and the combined body 202 and the outer sleeve 1 form the interference fit using relative toughness chimera.

In this embodiment, the interference fit connection is preferably adopted to connect the inner wall of the combined body 202 with the outer wall of the outer sleeve 1. The suction nozzle cap 2 is advantageously made of plastic materials. A first chamfer 28 configured to facilitate the outer sleeve 1 to insert into the combined body 202 is formed at an edge of the inner wall of an end of the combined body 202 away from the end cap 201.

In order to further facilitate the outer sleeve 1 to insert into the combined body 202, the combined body 202 can further define an external chamber 21 located adjacent to one side of the first chamfer 28 away from the end cap 201, and a second chamfer 23 is formed near the opening of the external chamber 21.

A sealing ring 3 is sheathed on one end of the outer sleeve 1 facing the suction nozzle cap 2. A second reserved space 32 is formed between one end of the sealing ring 3 near the suction nozzle cap 2 and the opening of the outer sleeve 1. A third reserved space 33 is formed between one end of the sealing ring 3 away from the suction nozzle cap 2 and an atomizer 11 contained in the outer sleeve 1. The second reserved space 32 is used for providing residence space for smoke arriving at the sealing ring 3. The third reserved space 33 reserves space for smoke buffer.

The sealing ring 3 defines a first containing chamber 31 and a through hole 30. The first containing chamber 31 is configured for condensing tobacco tar, and the first containing chamber is shape as a round table formed by gradually reducing a diameter of an edge of the sealing ring 3. The through hole 30 communicates with the smoking hole 20, and is aligned with or deviates from the smoking hole 20. In this embodiment, the through hole 30 is aligned with the smoking hole 20.

A third chamfer 24 configured to facilitate the sealing ring 3 to insert into the outer sleeve 1 is formed at an edge of the outer wall of one end of the sealing ring 3 away from the smoking hole 20.

By adopting the structure comprising the suction nozzle cap 2 sheathed on the outer sleeve 1, the disassembly of the suction nozzle cap 2 is more convenient. Furthermore, because the suction nozzle cap 2 is sheathed on the outside of the outer sleeve 1, the structure design of the suction nozzle cap 2 can be diversified. For example, the combined body 202 can be designed to include a first combined part 202*a* and a second combined part 202*b*, and a crease line 203 is formed between the first combined part 202*a* and the second combined part 202*b*. The first combined part 202*a* is fixedly connected with the end cap 201. An identification region is formed on an outer wall of the second combined part 202*b*, and there are concave and convex logos and texts on the identification region. The aim of setting the two combined parts is as follows: since the crease line 203 is formed between the first combined part 202*a* and the second combined part 202*b*, when either of the two combined parts is rotated or forced in the first use, the crease line 203 breaks and shows that the electronic cigarette has been ever opened. Moreover, the second combined part 202*b* is sheathed on the outside of the outer sleeve 1 and can move along the outer sleeve 1, and the second combined part 202*b* is provided with a mark configured to display some information of the electronic cigarette.

A Second Embodiment

Figure 4:
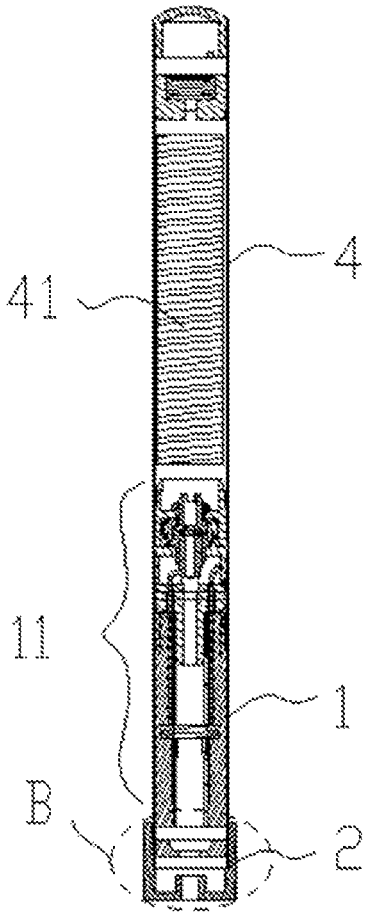
FIG. 4 is a cutaway view of an electronic cigarette of a second embodiment of the present application.
Figure 5:
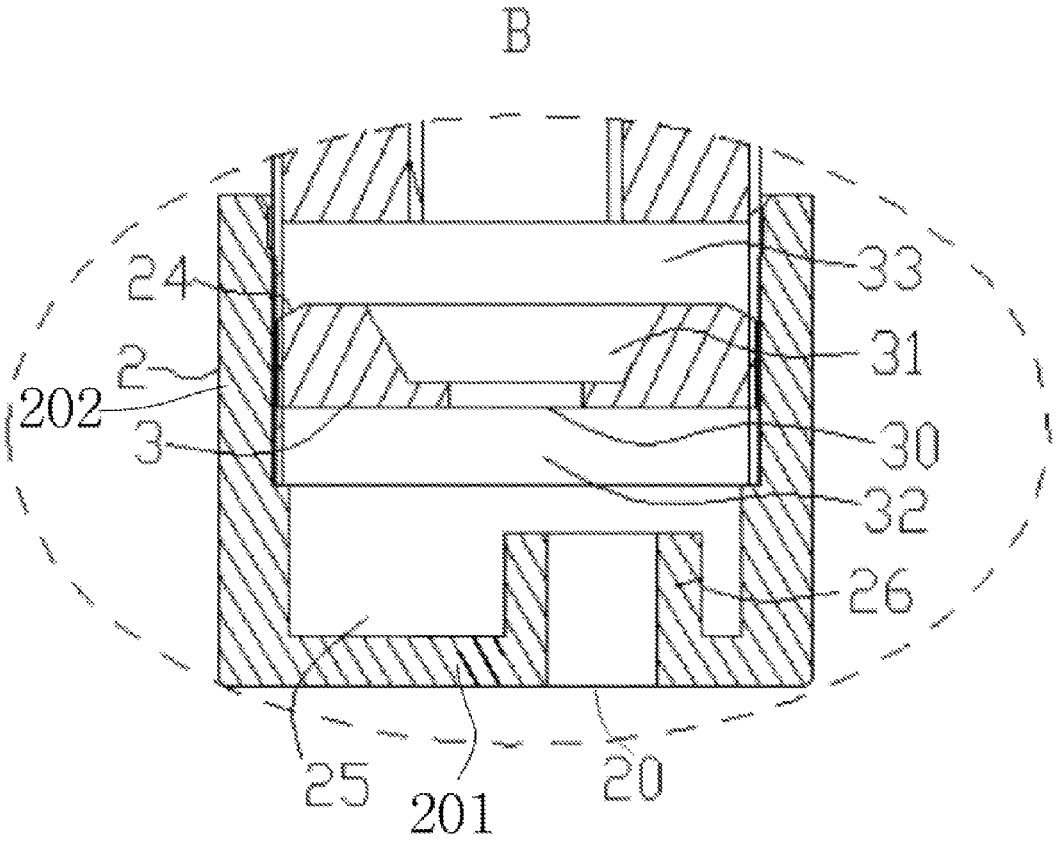
FIG. 5 is an enlarged view of the area B shown in FIG. 4.
Figure 6A:
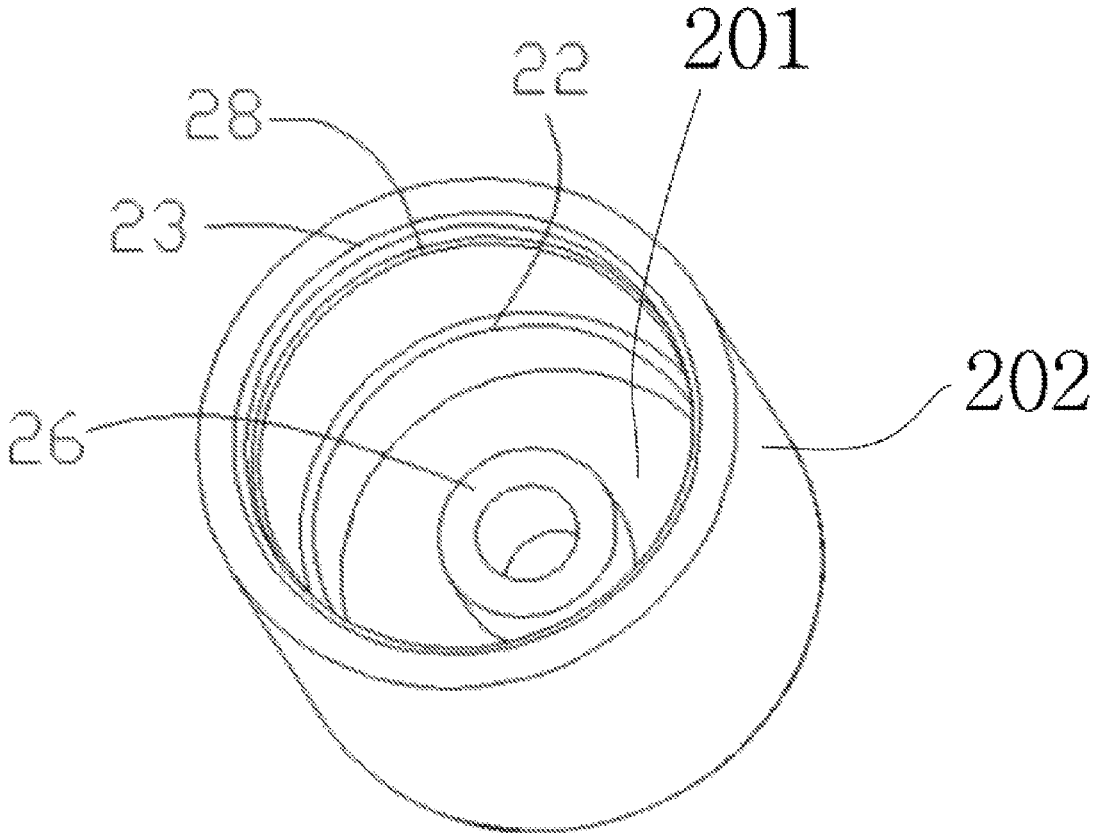
FIG. 6A is a three-dimensional structural view of a suction nozzle cap of the second embodiment of the present application.
Figure 6B:
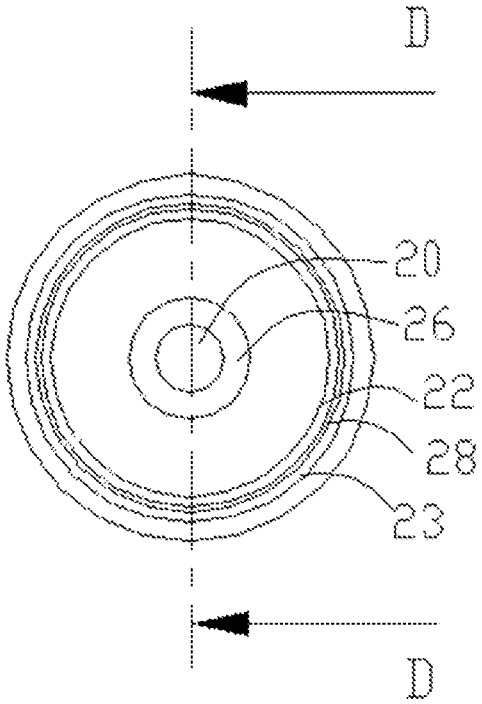
FIG. 6B is a vertical view of the suction nozzle cap of the second embodiment of the present application.
Figure 6C:
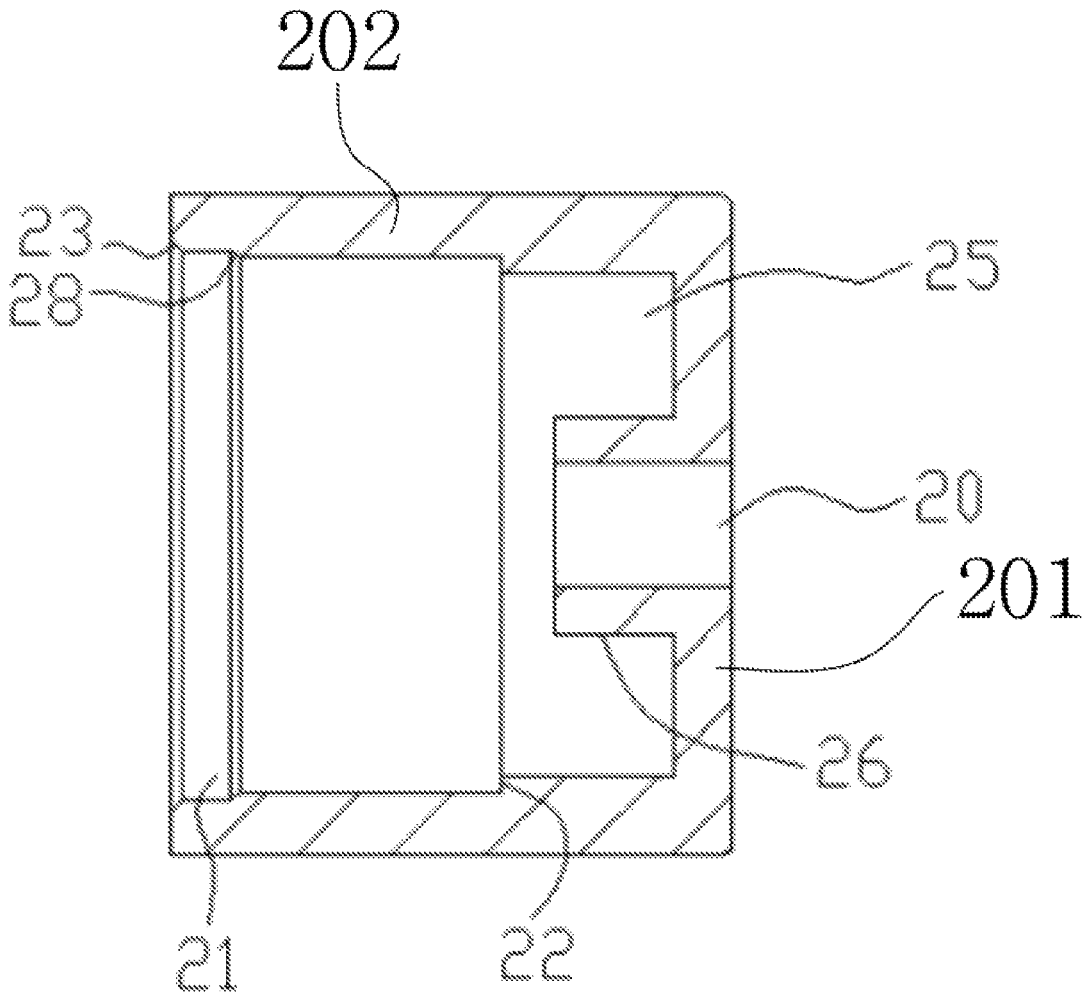
FIG. 6C is a cutaway view along the D-D line shown in FIG. 6B.

Referring to FIG. 4-FIG. 6C, an electronic cigarette of the second embodiment comprises an outer sleeve 1 and a suction nozzle cap 2 mounted at one end of the outer sleeve 1. Wherein, the suction nozzle cap 2 is sheathed on the outer sleeve 1, and an inner wall of the suction nozzle cap 2 is located on the outside of an outer wall of the outer sleeve 1. An atomizer 11 is accommodated in the outer sleeve 1. The electronic cigarette further comprises a battery sleeve 4, and a battery 41 is accommodated in the battery sleeve 4 to supply power to the atomizer 11.

The suction nozzle cap comprises an end cap 201 facing an opening end of the outer sleeve 1 and a combined body 202 sheathed on the outer sleeve 1, and the end cap 201 and the combined body 202 are integrated.

In this embodiment, a cross section of the combined body 202 is round, and an axial length of the combined body 202 is preferably 27 mm. Thus, the combined body 202 can be used to simulate a filter tip of a real cigarette lifelikely.

A smoking hole 20 is defined along an axial direction of the end cap 201, and a central axis of the smoking hole 20 deviates from a central axis of the outer sleeve 1.

A first reserved space 25 is formed between the inner wall of the end cap 201 and the opening of the outer sleeve 1, and a flange 22 can be formed at a contraction portion of the end cap 201 corresponding to the combined body 202 and is located adjacent to the combined body 202 to abut against the opening end of the outer sleeve 1. In one aspect, the first reserved space 25 can be used for secondary condensation of tobacco tar. In another aspect, a through hole can be defined at a circumference of an inner wall of the end cap 201 coating the first reserved space 25, and the through hole is used to replace the smoking hole 20 to discharge smoke to a mouth of a user. In this embodiment, smoke is preferably exhausted via the smoking hole 20, and no any other through hole is defined. An annular bulge 26 extends axially along an edge of the end cap 201 corresponding to a circumference of the smoking hole 20, and further extends toward the opening of the outer sleeve 1. The annular bulge 26 matches the first reserved space 25 to recycle secondarily condensed tobacco tar.

The inner wall of the combined body 202 is sheathed on the outer wall of the outer sleeve 1 corresponding to the combined body 202 along a preset sheathed direction. The inner wall of the combined body 202 and the outer wall of the outer sleeve 1 form an interference connection. The suction nozzle cap 2 can be designed to be elastic. In this embodiment, the suction nozzle cap 2 is advantageously made of plastics, and the combined body 202 and the outer sleeve 1 forms the interference fit using relative toughness chimera.

A first chamfer 28 configured to facilitate the outer sleeve 1 to insert into the combined body 202 is formed at an edge of an inner wall of an end of the combined body 202 away from the end cap 201.

In order to facilitate the outer sleeve 1 to insert into the combined body 202, the combined body 202 may further define an external chamber 21 located adjacent to one side of the first chamfer 28 away from the end cap 201, and a second chamfer 23 is formed near the opening of the external chamber 21.

A sealing ring 3 is sheathed on one end of the outer sleeve 1 facing the suction nozzle cap 2. A second reserved space 32 is formed between one end of the sealing ring 3 near the suction nozzle cap 2 and the opening of the outer sleeve 1. A third reserved space 33 is formed between one end of the sealing ring 3 away from the suction nozzle cap 2 and an atomizer 11 contained in the outer sleeve 1.

The sealing ring 3 defines a first containing chamber 31 and a through hole 30. The first containing chamber 31 is configured for condensing tobacco tar, and the first containing chamber is shaped as a round table formed by gradually reducing a diameter of an edge of the sealing ring 3. The through hole 30 communicates with the smoking hole 20, and is aligned with the smoking hole 20.

A third chamfer 24 configured to facilitate the sealing ring 3 to insert into the outer sleeve 1 is formed at a circumferential edge of one end of the sealing ring 3 away from the smoking hole 20.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. All these modifications belong to the protection of the present application.

What is claimed is:

1. An electronic cigarette, comprising an outer sleeve and a suction nozzle cap mounted at one end of the outer sleeve; wherein, the suction nozzle cap is sheathed on the outer sleeve, and an inner wall of the suction nozzle cap is located on an outer wall of the outer sleeve;

wherein, the suction nozzle cap includes an end cap facing an opening end of the outer sleeve and a combined body sheathed on the outer sleeve, wherein the end cap and the combined body are integrated, and the end cap defines a smoking hole: an edge of an inner wall of the end cap abuts with the opening end of the outer sleeve, and a central axis of the smoking hole deviates from a central axis of the outer sleeve: a first reserved space is formed between the inner wall of the end cap and the opening end of the outer sleeve: an annular bulge extends from an edge of the end cap corresponding to a circumference of the smoking hole to the opening end of the outer sleeve axially;

wherein, the combined body includes a first combined part and a second combined part, a crease line is formed between the first combined part and the second combined part, when either of the two combined parts is rotated or forced in the first use, the crease line breaks and shows that the electronic cigarette has been ever opened: the second combined part is sheathed on the outside of the outer sleeve and can move along the outer sleeve.

2. The electronic cigarette according to claim 1, wherein, a cross section of the combined body is round, oval or polygonal.

3. The electronic cigarette according to claim 1, wherein, an axial length of the combined body ranges from 20 mm to 33 mm.

4. The electronic cigarette according to claim 1, wherein, a flange configured to abut against the opening end of the outer sleeve is formed on the combined body.

5. The electronic cigarette according to claim 1, wherein, an inner wall of the combined body and the outer wall of the outer sleeve form any one of interference fit, buckled connection, and threaded connection.

6. The electronic cigarette according to claim 5, wherein, at least one convex rib or at least one groove is radially formed on a circumference of a portion of the outer wall of the outer sleeve that contacts the inner wall of the combined body, and at least one groove or at least one convex rib is radially formed on the inner wall of the combined body correspondingly, and the combined body and the outer sleeve are mutually buckled.

7. The electronic cigarette according to claim 5, wherein, an external thread or an internal thread is radially formed on a circumference of a portion of the outer wall of the outer sleeve that contacts the inner wall of the combined body, an internal thread or an external thread is radially formed on the inner wall of the combined body correspondingly, and the combined body and the outer sleeve are thread-connected.

8. The electronic cigarette according to claim 5, wherein, the combined body is elastic, and the combined body and the outer sleeve form interference fit.

9. The electronic cigarette according to claim 1, wherein, a first chamfer configured to facilitate the outer sleeve to insert into the combined body is formed at an edge of the inner wall of an end of the combined body away from the end cap.

10. The electronic cigarette according to claim 9, wherein, a sealing ring is sheathed on one end of the outer sleeve facing the suction nozzle cap, a second reserved space is formed between one end of the sealing ring near the suction nozzle cap and the opening of the outer sleeve, and a third reserved space is formed between one end of the sealing ring away from the suction nozzle cap and an atomizer received in the outer sleeve.

11. The electronic cigarette according to claim 10, wherein, the sealing ring defines a first containing chamber and a through hole; the first containing chamber is configured for condensing tobacco tar, and the first containing chamber is shaped as a round table and is formed by gradually reducing a diameter of an edge of the sealing ring; the through hole communicates with the smoking hole, and is aligned with or deviates from the smoking hole.

12. The electronic cigarette according to claim 11, wherein, a third chamfer configured to facilitate the outer sleeve to insert into the sealing ring is formed at an edge of the outer wall of one end of the sealing ring away from the smoking hole.

* * * * *